US010856595B2

(12) United States Patent
Bunting

(10) Patent No.: US 10,856,595 B2
(45) Date of Patent: Dec. 8, 2020

(54) MAGNETIC CLOTHING STAY METHODS AND SYSTEMS

(71) Applicant: Magnetucks, LLC, Westford, MA (US)

(72) Inventor: Philip Bunting, Portland, OR (US)

(73) Assignee: Magnetucks, LLC, Westford, MA (US)

( * ) Notice: Subject to any disclaimer, the term of this patent is extended or adjusted under 35 U.S.C. 154(b) by 276 days.

(21) Appl. No.: 16/135,917

(22) Filed: Sep. 19, 2018

(65) Prior Publication Data

US 2019/0014843 A1 Jan. 17, 2019

Related U.S. Application Data

(63) Continuation of application No. 14/566,450, filed on Dec. 10, 2014, now abandoned.

(60) Provisional application No. 61/922,611, filed on Dec. 31, 2013.

(51) Int. Cl.
*A41F 1/00* (2006.01)

(52) U.S. Cl.
CPC ..... *A41F 1/002* (2013.01)

(58) Field of Classification Search
CPC ..... A41F 1/002
USPC ..... 2/229, 258, 260, 336, 337, 79, 269, 326
See application file for complete search history.

(56) References Cited

U.S. PATENT DOCUMENTS

D41,808 S 9/1911 Liebmann
D144,495 S 4/1946 Drell
4,015,296 A 4/1977 Malick
4,399,595 A 8/1983 Yoon et al.
4,715,839 A * 12/1987 Ford ..... A44B 11/001 2/300
4,969,241 A 11/1990 Griffin
5,067,179 A * 11/1991 Wormser ..... A41D 10/00 2/239
5,232,752 A 8/1993 Crespi
5,567,037 A 10/1996 Ferber
5,604,960 A 2/1997 Good
5,682,653 A 11/1997 Berglof et al.
5,740,558 A 4/1998 Messman
5,956,816 A 9/1999 McCrink
5,974,634 A 11/1999 Eisenpresser
6,006,365 A * 12/1999 Strandberg ..... A41F 3/00 2/227
6,216,275 B1 4/2001 Lee
6,260,749 B1 * 7/2001 Horovitz ..... A45F 5/02 206/5
6,505,385 B2 1/2003 Grunberger
(Continued)

FOREIGN PATENT DOCUMENTS

FR 2804292 8/2001

*Primary Examiner* — Gloria M Hale
(74) *Attorney, Agent, or Firm* — Mohr Intellectual Property Law Solutions, PC

(57) ABSTRACT

Magnetic clothing stay methods including gripping a first clothing item between a first body and second body of a clothing stay near an edge of the first clothing item, the first body having a first magnetic element and the second body having a second magnetic element, tucking the edge of the first clothing item underneath a second clothing item, contacting an inner surface of the second clothing item with an outer surface of the clothing stay, and thereby retarding movement of the first clothing item relative to the second clothing item via friction between the outer surface of the clothing stay and the inner surface of the second clothing item.

20 Claims, 3 Drawing Sheets

(56) References Cited

U.S. PATENT DOCUMENTS

| | | | | |
|---|---|---|---|---|
| 6,748,602 | B1 | 6/2004 | Barnes | |
| 7,065,841 | B2 * | 6/2006 | Sjoquist | A41F 1/002 24/303 |
| 7,373,696 | B2 * | 5/2008 | Schoening | A41D 25/003 24/303 |
| 7,409,730 | B2 | 8/2008 | Boos | |
| 7,992,264 | B2 * | 8/2011 | Abadi | A44B 9/08 24/303 |
| 8,108,948 | B2 | 2/2012 | Boos | |
| 8,327,510 | B2 * | 12/2012 | Schlesinger | A41F 17/02 24/459 |
| 8,769,780 | B1 * | 7/2014 | Segel | A41F 1/002 24/302 |
| 9,204,676 | B2 * | 12/2015 | Gbadamosi | A41D 15/00 |
| 2005/0039243 | A1 | 2/2005 | Henderson | |
| 2006/0265841 | A1 | 11/2006 | Abadi | |
| 2006/0272076 | A1 * | 12/2006 | Schroeder | A41F 5/00 2/336 |
| 2012/0079688 | A1 | 4/2012 | Bunting | |
| 2012/0266354 | A1 * | 10/2012 | Clough | A41D 25/003 2/129 |
| 2014/0013493 | A1 | 1/2014 | Blunt | |
| 2014/0366242 | A1 | 12/2014 | Pulsifer | |
| 2015/0113843 | A1 | 4/2015 | Berry | |

* cited by examiner

MAGNETIC CLOTHING STAY METHODS AND SYSTEMS

This application is a continuation of and claims priority to copending, now abandoned, U.S. patent application Ser. No. 14/566,450, filed on Dec. 10, 2014, which is hereby incorporated by reference for all purposes. U.S. patent application Ser. No. 14/566,450 claims priority to U.S. Provisional Patent Application, Ser. No. 61/922,611, filed on Dec. 31, 2013, which is hereby incorporated by reference for all purposes.

BACKGROUND

The present disclosure relates generally to clothing stay methods and systems for men's and/or women's clothing. In particular, magnetic clothing stay methods and systems are described.

In many professional environments, is desirable to have a neat and tidy appearance, particularly in the appearance of clothing or garments. Through normal wear, however, it may be difficult to maintain the position one clothing item relative to another. Simply through the actions of walking, sitting, standing, and general movement, an item of clothing may become rumpled and/or slip relative to another item of clothing. For example, a shirt may become untucked from a waistline of a wearer's pants. In another example, a shirt may become untucked from a waistline of a wearer's skirt.

Known garment stay devices are not entirely satisfactory for the range of applications in which they are employed. For example, existing garment stays are awkward to operate as they can be in a location that is difficult to reach. In another example, conventional garment stay devices are often permanently associated with a clothing item and therefore are not transferable to other clothing items, limiting a wearer's selection of clothing. In yet another example, a clothing stay may be uncomfortable and/or irritable to a wearer. In even another example, a clothing stay may pierce and/or otherwise damage clothing in order to function.

Thus, there exists a need for clothing stay devices and systems that improve upon and advance the design of known clothing stay devices and systems. Examples of new and useful clothing stay devices and systems relevant to the needs existing in the field are discussed below.

Disclosure addressing one or more of the identified existing needs is provided in the detailed description below. Examples of references relevant to clothing stay devices and systems include U.S. Patent References: patent application publication 2012/0079688, U.S. Pat. Nos. 8,108,948, 7,409,730, 7,373,696, 7,065,841, 6,748,602, 6,505,385, 6,216,275, 5,740,558, 5,682,653, 5,604,960, 4,399,595, and 4,015,296. The complete disclosures of the above patents and patent applications are herein incorporated by reference for all purposes.

SUMMARY

The present disclosure is directed to magnetic clothing stay systems including a first magnetically attractable partner having a first body, a first magnetically attractable element, a first mating surface, and an outer clothing item contacting surface. The clothing stay system further comprises a second magnetically attractable partner having a second body, a second magnetically attractable element, and a second mating surface, the first mating surface being matable to the second mating surface. In some examples, the first body has a generally dome-shaded body, the first mating surface being a flat floor of the dome-shaped body, the outer clothing item contacting surface being an outer curved surface of the dome-shaped body. In some further examples, the second body has a generally disc-shaped body, the second mating surface being a first flat side of the disc-shaped body.

DETAILED DESCRIPTION

The disclosed clothing stay methods and systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of clothing stay methods and systems examples are provided. Related features in the examples may be identical, similar, or dissimilar in different examples. For the sake of brevity related features will not redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
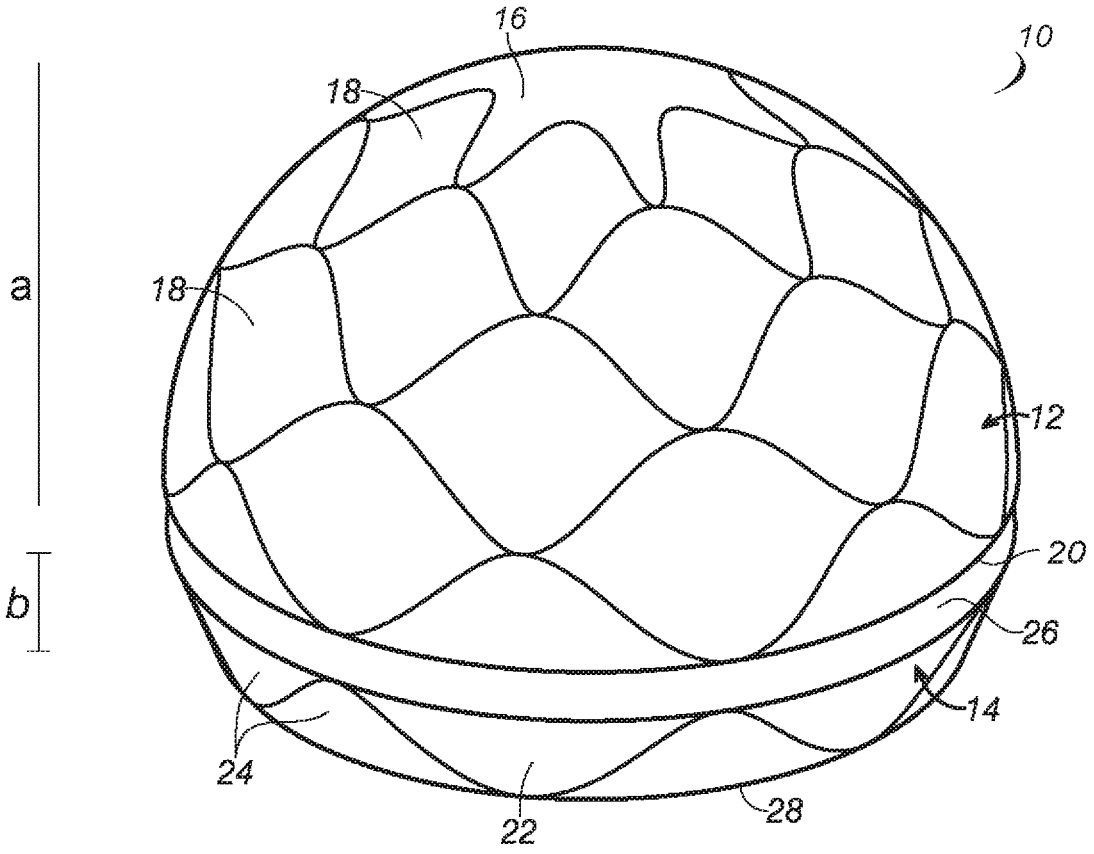
FIG. 1 is a top side perspective view of a first example of a magnetic clothing stay device.
Figure 2:
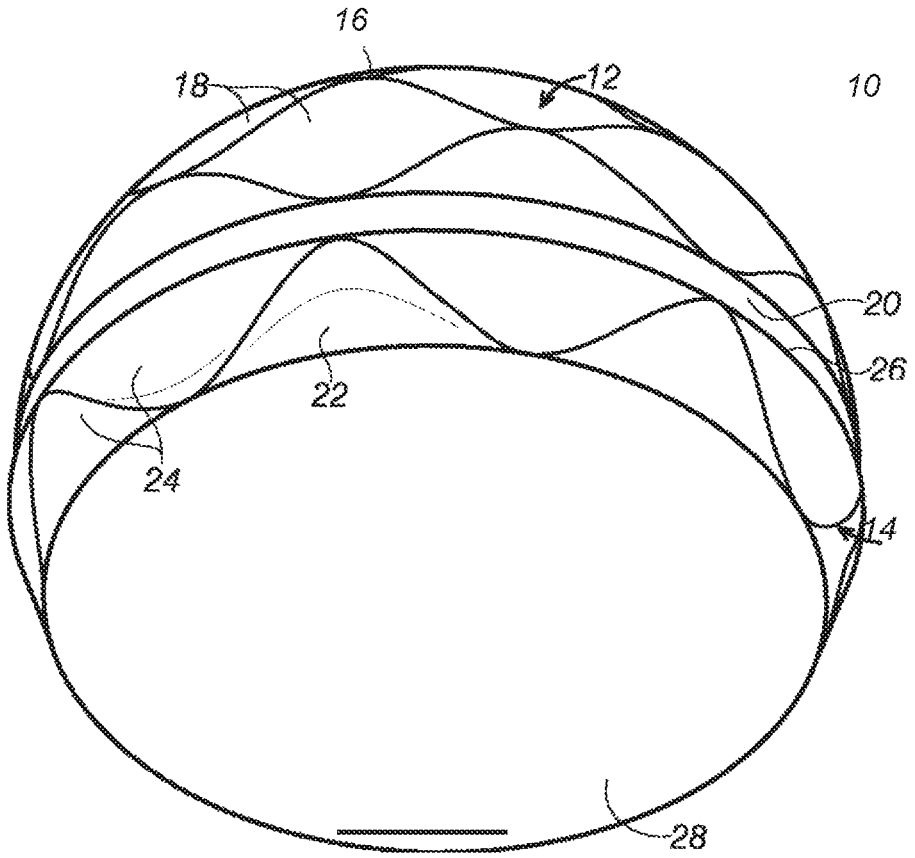
FIG. 2 is a bottom side perspective view of the magnetic clothing stay device shown in FIG. 1.
Figure 3:
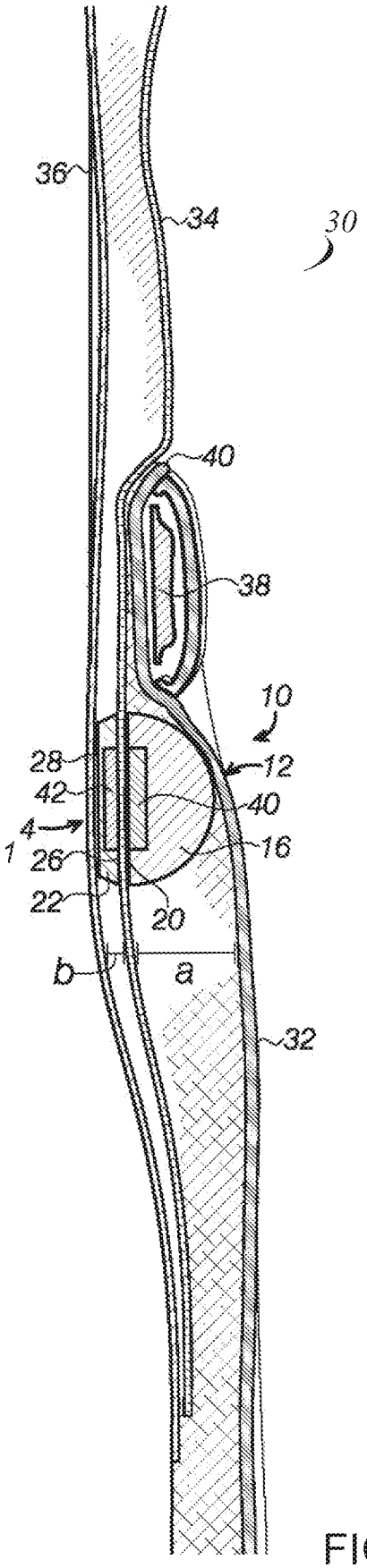
FIG. 3 is a cross-sectional view showing an example arrangement of the magnetic clothing stay engaged with clothing items of a wearer.

With reference to FIGS. 1-3 a first example of a magnetic clothing stay, magnetic clothing stay 10, will now be described. Magnetic clothing stay 10 functions to maintain a position of a wearer's clothing during daily activities, such as maintaining a position of a shirt relative to a waistline of a wearer's pants. Additionally or alternatively, magnetic clothing stay 10 can be used to maintain a position of a shirt relative to a waistline of a skirt.

Magnetic clothing stay 10 addresses many of the shortcomings existing with conventional garment stays. For example, the presently described magnetic clothing stay is easy to operate and transferable to any clothing item. Further, the presently described magnetic clothing stay does not damage clothing or cause discomfort to a user during operation and wear.

As shown in FIGS. 1-3, magnetic clothing stay system 10 includes a first magnetically attractable partner 12 (e.g., a first magnetic assembly) magnetically paired to a second magnetically attractable partner 14 (e.g., a second magnetic assembly). In other examples, the magnetic clothing stay includes an additional magnetically attractable partner magnetically paired to the second magnetically attractable partner.

As can be seen in FIGS. 1 and 2, magnetically attractable partner 12 has a generally dome-shaped body 16 with a plurality of facets 18 evenly distributed over the domed surface of the body. Dome-shaped body 16 has a height a. In one specific example, the height a is 0.5 in. In alternate embodiments, the first magnetically attractable partner may have an alternative shape. For example, the first magnetically attractable partner can be cuboid, pyramidal, or stepped.

The domed surface of body 16 is configured to contact an inner surface of an outer clothing item, such as a pair of pants or a skirt (as depicted in FIG. 3). Because the plurality of facets are on the surface of the domed portion (i.e., curved surface) of the body, they substantially comprise a clothing contacting surface. Facets 18 can increase friction between the dome-shaped body and the inner surface of the outer clothing item. Accordingly, facets 18 can substantially comprise a gripping surface.

Body 16 further includes a flat mating surface 20, which is a floor of the dome-shaped body. In other words, the domed portion of the body is on a first side and the flat mating surface is on a second opposing side. Mating surface 20 is a location where first magnetically attractable partner 12 can be magnetically plated with second magnetically attractable partner 14.

Within body 16 and proximal to mating surface 20, there is at least one magnetically attractable element 40 (shown in FIG. 3). For example, body 16 may include a rare-earth magnetic material. In one specific example, the body includes one or more magnetic members comprised of neodymium ferrite boron. In alternate examples, the magnetically attractable element may be any magnetically attractable material, such as iron or another magnetically attractable metal.

Further, body 16 can be comprised of a soft and/or tacky rubber material that additionally increases friction between the dome-shaped body and the inner surface of the outer clothing item. In one example, body 16 is comprised of an elastomeric compound. In one specific example, the body is comprised of silicone. It will be appreciated that in some examples, the body may have an outer surface layer comprised of an elastomeric compound and a central portion comprised of a different material.

In alternate examples, the dome-shaped body may be substantially smooth (i.e., without facets) or include another configuration for a gripping surface, such as a surface covered with small flexible projections. In other alternate examples, the dome-shaped body may be comprised of a harder material, such as plastic, wood, or metal.

As depicted in FIGS. 1 and 2, second magnetically attractable partner 14 has a generally disc-shaped body 22 with a plurality of facets 24 evenly distributed over an outer curved wall of body 22. Disc-shaped body 22 has a height b. In general, the height b is less than the height a. In one specific example, the height b is 0.1875 in.

Body 22 has a flat mating surface 26 on a first side of the body that can make abutting surface-to-surface contact with mating surface 14. It will be appreciated that during use, a portion of a clothing item is retained between mating surface 26 and mating surface 14, and the magnetically attractable partners are paired without making surface-to-surface contact (as depicted in FIG. 3 and described below).

Within body 22 and proximal to mating surface 26, there is at least one magnetically attractable element 42 (shown in FIG. 3). For example, body 22 may include a rare earth magnet, such as neodymium or neodymium ferrite boron. In alternate examples, the magnetically attractable element may be any magnetically attractable material, such as iron or another rare earth magnetically attractable metal.

When engaged with an inner clothing item (as shown in FIG. 3) such as a tucked-in portion of a shirt, the material of the inner clothing is laid flat between mating surfaces 20 and 26. In this case, mating surface 26 makes surface-to-surface contact with an inner surface of the inner clothing item and mating surface 20 makes surface-to-surface contact with an outer surface of the inner clothing item.

Body 22 further includes a flat surface 28. Flat surface 28 opposes mating surface 26 and lies on an outer surface of magnetic clothing stay 10 when the first and second magnetic assemblies are magnetically paired. When worn, surface 28 can contact the skin of the wearer or an outer surface of an undergarment, such as a t-shirt or a slip.

Body 22 can be comprised of a tacky rubber and/or elastomeric material that increases friction between the disc-shaped body and the inner surface of the inner clothing item. In one example, body 22 is comprised of silicone. In alternate examples, the disc-shaped body may include a gripping surface, such as a surface covered with small flexible projections. In other alternate examples, the disc-shaped body may be comprised of a harder material, such as plastic, wood, or metal.

FIG. 3 shows a cross-sectional view of a wearer 30 wearing an outer clothing item 32 (e.g., a pair of pants or a skirt), an inner clothing item 34 (e.g., a tucked-in portion of a shirt), and an undergarment 36 (e.g., a t-shirt or a slip). Wearer 30 is further wearing a belt 38 at the wearer's waistline 40. Wearer 30 is also additionally wearing magnetic clothing stay 10. A position of inner clothing item 34 is maintained relative to outer clothing item 32 by magnetic clothing stay 10.

As depicted in FIG. 3, a surface of first magnetically attractable partner 12 contacts an inner surface of outer clothing item 32. A top side of first magnetically attractable partner 12 is proximal to waistline 40 and belt 38. Mating surface 20 contacts an outer surface of inner clothing item 34 and is magnetically paired (i.e., magnetically mated) to mating surface 26. Inner clothing item 34 is captured between mating surfaces 20 and 26. In this configuration, mating surface 26 contacts an inner surface of inner clothing item 34 and surface 28 contacts an outer surface of undergarment 36. First magnetically attractable partner 12 is configured to be abutted to waistline of the outer clothing item when an upward force is applied on inner clothing item 34. Thus, the clothing stay system limits "untucking" and/or movement of the inner clothing item relative to the outer clothing item.

In an alternate example, the wearer may not have an undergarment and surface 28 may contact that skin of the wearer. In another alternate example the wearer may not have a belt and first magnetic attractable partner 12 may be abutted only to waistline 40. In even another example the undergarment can additionally be retained between the first magnetic partner and the second magnetic partner.

In the examples shown in FIGS. 1 and 3, as stated above, the height a is greater than the height b. In general, the height b is a sufficient distance so that the second magnetically attractable partner is small and generally flat. Thus, the second magnetically attractable partner may be undetectable to and comfortable to be worn by the user. In general, the height a is a sufficient distance so that the first magnetically attractable partner may be engaged with and abutted against the waist line of the wearer's outer clothing item (e.g., pants, skirt, belt, etc.). Thus, when the wearer moves about during normal daily activity, such as by lifting the wearer's arms to reach for an object on a shelf, the first magnetically attractable partner does not go above the waistline.

Because the inner clothing item is captured and/or releasably retained between the first magnetically attractable partner and the second magnetically attractable partner, the position of the inner clothing item relative to the outer clothing item is maintained. Therefore, the magnetic clothing stay system functions to maintain a neat and tidy appearance of the wearer's clothing items. In alternate embodiments, the magnetic clothing stay may include a third magnetically attractable partner that magnetically pairs to the second magnetically attractable partner on an inner surface of the undergarment to additionally maintain a position of the undergarment relative to the inner clothing item and the outer clothing item.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A method of holding first and second clothing items in place relative to each other, the method comprising:

gripping a first clothing item between a first body and second body of a clothing stay proximal an edge of the first clothing item, the first body having a first magnetic element and the second body having a second magnetic element;

tucking the edge of the first clothing item underneath a second clothing item;

contacting an inner surface of the second clothing item with an outer surface of the clothing stay;

retarding movement of the first clothing item relative to the second clothing item via friction between the outer surface of the clothing stay and the inner surface of the second clothing item.

2. The method of claim 1, wherein the first clothing item is a shirt.

3. The method of claim 2, wherein the second clothing item is a pair of pants or shorts having a waistband.

4. The method of claim 3, comprising:

positioning the clothing stay proximal the waistband.

5. The method of claim 1, wherein the gripping comprises pinching the first clothing item between the first and second bodies via magnetic attraction of the first and second magnetic elements.

6. The method of claim 5, wherein the first and second magnetic bodies are covered in elastomeric material configured to increase the friction between the first and second bodies and the first clothing item.

7. The method of claim 6, wherein the elastomeric material comprises silicone.

8. The method of claim 1, wherein the gripping comprises:

placing the first body on an inside surface of the first clothing item;

placing the second body on an outside surface of the first clothing item; and aligning the first and second bodies such that the first and second magnetic elements are facing each other with the first clothing item between them.

9. The method of claim 1, wherein the clothing stay is a first clothing stay, the method comprising: placing a plurality of clothing stays, including the first clothing stay, proximal the edge of the first clothing item.

10. The method of claim 1, wherein the outer surface of the clothing stay is a domed surface.

11. The method of claim 10, wherein the domed surface comprises facets.

12. A method of holding a shirt inside a pair of pants or shorts, the method comprising:

placing a plurality of clothing stays proximal a bottom edge of the shirt, wherein the placing comprises:

gripping a bottom edge of the shirt between a first body and second body of a first clothing stay of the plurality of clothing stays, the first body having a first magnetic element and the second body having a second magnetic element;

tucking the edge of the shirt underneath the pants or shorts;

contacting an inner surface of the pants or shorts with outer surfaces of the plurality of clothing stays;

retarding upward movement of the shirt relative to the pants or shorts via friction between the outer surfaces of the clothing stays and the inner surface of the pants or shorts.

13. The method of claim 12, wherein the pants or shorts comprise a waistband, the method comprising:

positioning the plurality of clothing stays around the bottom edge of the shirt and proximal the waistband.

14. The method of claim 12, wherein the gripping comprises pinching the shirt between the first and second bodies via magnetic attraction of the first and second magnetic elements.

15. The method of claim 12, wherein the first and second magnetic bodies are covered in an elastomeric material configured to increase the friction between the first and second bodies and the first clothing item.

16. The method of claim 15 wherein the elastomeric material comprises silicone.

17. The method of claim 12, wherein the gripping comprises:

placing the first body on an inside surface of the shirt;

placing the second body on an outside surface of the shirt; and aligning the first and second bodies such that the first and second magnetic elements are facing each other with the shirt in between them.

18. The method of claim 12, wherein the outer surface of the first clothing stay is a domed surface.

19. The method of claim 18, wherein the domed surface comprises facets.

20. The method of claim 12 wherein the first body is generally dome-shaped and the second body is cylindrical.

* * * * *